US006226464B1

(12) United States Patent
Suwa et al.

(10) Patent No.: US 6,226,464 B1
(45) Date of Patent: May 1, 2001

(54) DEVELOPER APPARATUS FEATURING A DEVELOPER CONTAINER PARTITION PORTION DISPOSED BETWEEN A DETECTING MEMBER AND AN AGITATING MEMBER

(75) Inventors: Koichi Suwa, Kawasaki; Keiji Okano, Tokyo; Masahiro Yoshida, Kashiwa; Hideki Matsumoto, Mishima; Satoshi Sunahara, Funabashi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/422,098

(22) Filed: Oct. 20, 1999

(30) Foreign Application Priority Data

Oct. 23, 1998 (JP) ..... 10-302511
Oct. 23, 1998 (JP) ..... 10-302537

(51) Int. Cl.[7] ..... G03G 15/08; G03G 15/00
(52) U.S. Cl. ..... 399/27; 399/254
(58) Field of Search ..... 399/27, 61, 62, 399/252, 254

(56) References Cited

U.S. PATENT DOCUMENTS 5,243,390 * 9/1993 Takemoto et al. ..... 399/254
5,864,731 * 1/1999 Ikemoto et al. ..... 399/27
6,026,253 * 2/2000 Domon et al. ..... 399/27 X

FOREIGN PATENT DOCUMENTS 9-204095 * 8/1997 (JP) .
2682003 8/1997 (JP) .
10-104943 4/1998 (JP) .

OTHER PUBLICATIONS

Abstract for JP 1–52182 A, Feb. 1989.*

* cited by examiner

*Primary Examiner*—Joan Pendegrass
(74) *Attorney, Agent, or Firm*—Fitzpatrick, Cella, Harper & Scinto

(57) ABSTRACT

The present invention relates to a developing apparatus in which, assuming that a tangent which is in contact with said detecting member on an opening portion side of a developing container in a vertical direction is a first tangent, and a tangent which is in contact with a rotating locus of a first agitating member on an opposite side of the opening portion in a vertical direction is a second tangent, the first tangent is positioned nearer to the opening portion than the second tangent, and a lower end of said partition member is provided between the first tangent and the second tangent.

12 Claims, 13 Drawing Sheets

FIG. 17

| HEIGHT OF PARTITION PORTION | DENSITY OF SOLID IMAGE | AMOUNT OF FINE PARTICLES (%) | FADING |
|---|---|---|---|
| (a) | 1.40 | 15 | OCCURRED |
| (b) | 1.39 | 16 | OK |
| (c) | 1.36 | 19 | OK |
| (d) | 1.33 | 23 | OK |
| REFERENCE | 1.33 | 23 | OK |

FIG. 18

| PARTITION MATERIAL | DENSITY OF SOLID IMAGE | | AMOUNT OF FINE PARTICLES (%) | FADING |
|---|---|---|---|---|
| | END PORTION | CENTER PORTION | | |
| PARTITION MATERIAL 2 | 1.38 | 1.39 | 17 | OK |
| REFERENCE | 1.33 | 1.38 | 24 | OK |

| HEIGHT OF PARTITION PORTION | DENSITY OF SOLID IMAGE | AMOUNT OF FINE PARTICLES (%) | FADING |
|---|---|---|---|
| (a) | 1.42 | 13 | OCCURRED |
| (b) | 1.41 | 15 | OK |
| (c) | 1.38 | 19 | OK |
| (d) | 1.35 | 21 | OK |
| REFERENCE | 1.33 | 23 | OK |

DEVELOPER APPARATUS FEATURING A DEVELOPER CONTAINER PARTITION PORTION DISPOSED BETWEEN A DETECTING MEMBER AND AN AGITATING MEMBER

BACKGROUND OF THE INVENTION

1. Field of the Invention

The present invention relates to a developing apparatus which is applicable to an image forming apparatus such as an electrophotographic apparatus.

2. Related Background Art

FIG. 9 shows an example of a conventional image forming apparatus having a developing apparatus. FIG. 9 is a vertical cross-sectional view showing the schematic structure of the image forming apparatus, and referring to the figure, the outline of the conventional image forming apparatus will be described.

A photosensitive drum (image bearing member) 111 is rotationally driven in a direction indicated by an arrow RI so that after a surface of the photosensitive drum 111 is uniformly charged by a charging roller (charging device) 103, it is subject to exposure by an exposing device 102 to thereby form an electrostatic latent image on the surface of the photosensitive drum 111. The electrostatic latent image is developed as a toner image by a developing apparatus 208. The toner image on the photosensitive drum 111 is transferred to a transfer material 114 by a transfer roller (transfer device) 110. The transfer material 114 which has been received in a sheet feed cassette 117 is supplied by a sheet feed roller 116 and so on. Toner which is not transferred and remains on the surface of the photosensitive drum 111 from which the toner image has been transferred is removed by a cleaning blade 113 of a cleaning device 112 for succeeding image formation. On the other hand, the toner image which has been transferred to the transfer material 114 is fixed onto the surface of the transfer material 114 by a fixing device 115 and thereafter discharged to the exterior of an image forming apparatus main body 101. With the above operation, image formation is completed.

FIG. 10 shows an example of a conventional developing apparatus. FIG. 10 is an enlarged diagram of the developing apparatus 208 shown in FIG. 9. Referring to the figure, the outline of the conventional developing apparatus will be described.

The developing apparatus 208 shown in the figure is comprised of a developing apparatus using one-magnetic-component toner. A developing sleeve (developer bearing member) 105 is comprised of a non-magnetic sleeve which is formed of a pipe made of aluminum or stainless steel and rotatably supported in a direction indicated by an arrow R2. Inside of the developing sleeve 105 is fixedly disposed a magnet 106 having a plurality of N-poles and S-poles which are alternately formed. A surface of the developing sleeve 105 is so processed as to provide an appropriate surface roughness so that a desired amount of toner can be carried. The surface of the developing sleeve 105 abuts against one end of an elastic blade (developer regulation member) 107*a* under a given pressure. The elastic blade 107*a* is made of, for example, urethane rubber, silicon rubber or the like and the end of the elastic blade 107*a* is fixed to a support plate 107*b*. Toner 109 which has been attracted to the surface of the developing sleeve 105 due to a magnetic force of the magnet 106 is supplied with an appropriate amount of charges by a frictional charge caused by bearing and carrying the toner 109 on the developing sleeve 105 and a frictional charge caused by sliding friction between the developing sleeve 105 and the elastic blade 107*a* at the time where the toner 109 is regulated to an appropriate amount by the elastic blade 107*a*. The toner 109 is then carried to a developing region.

Also, the developing apparatus 208 is designed in such a manner that, as shown in FIG. 15, rollers 209 are disposed at both end portions of the developing sleeve 105, and the rollers 209 are allowed to abut against the photosensitive drum 111 so that a given interval is provided between the surface of the developing sleeve 105 and the surface of the photosensitive drum 111. A developing sleeve gear 212 is fixed onto one end of the developing sleeve 105 so that the developing sleeve 105 is rotationally driven by a drive force which is transmitted to the developing sleeve gear 212 from a photosensitive drum gear 211 integral with the photosensitive drum 111.

As means for detecting the remaining amount of toner in the developing apparatus 208 thus structured, there has been known, up to now, a technique in which a variation in current which is induced by an a.c. developing bias supply power source 118 is detected by an antenna member 108 disposed in parallel with the developing sleeve 105, using a variation in impedance which is accompanied by a variation in the amount of toner between the developing sleeve and the antenna as shown in FIG. 10, to thereby estimate the remaining amount of toner (hereinafter referred to as "induced current detecting means). The power source for supplying the developing bias includes not only the above-described a.c. developing bias supply power source 118 but also a d.c. developing bias supply power source 119, by which a developing bias where a.c. voltage and d.c. voltage are superposed on each other is supplied to the above-described developing sleeve 105.

The induced current detecting means is made up of the respective members 120 to 123 in FIG. 10. Reference numeral 120 denotes a capacitor having an electrostatic capacitance equal to that in a state where no toner exists. The electrostatic capacitance of the capacitor 120 and an electrostatic capacitance detected by the antenna member 108 are compared with each other after they pass through diodes 121 and 122, respectively, to thereby judge whether the toner exists or not.

In the case of detecting the remaining amount of toner, the antenna member 108 disposed inside of a developing container 104 in the longitudinal direction may prevent the movement of toner. In particular, because a toner wall is liable to be formed between the lower portion of the developing container 104 and the antenna member 108, a method has been conventionally applied in which an agitating member 130 is disposed at the lower portion of the antenna member 108 so that the supply of toner to the developing sleeve 105 is smoothed while toner is being unraveled.

As the agitating member 130, there is used a crank-shaped bar member as shown in FIG. 11, which is rotated in a direction indicated by an arrow R3 with both end portions thereof as a rotating center. This is a conventional method.

Also, an agitating member 7 is so disposed as to unravel the toner within the developing container 104 and deliver the toner to the agitating member 130. The agitating member 7 is formed of a crank-shaped bar member as in the agitating member 130 as shown in FIG. 12, which is rotated in a direction indicated by an arrow R4 in FIG. 10 with both end portions thereof as a rotating center. In general, a driving force that permits the agitating member 130 and the agitating member 7 to rotate is obtained, for example, by lowering the driving force transmitted from the above-described developing sleeve gear 212 (refer to FIG. 15) to an appropriate rotating speed through a gear train.

However, for example, in the image forming apparatus of the digital system which performs exposure by a laser beam, with the decreased diameter of the toner for the purpose of improving the reproducibility of one dot, a tendency is given to lower the density of an image for some time after the developing apparatus 208 structured in the above manner starts to operate.

FIG. 13 is a graph representative of an initial image density transition with respect to a difference in toner average (center) particle diameters. Although the initial density is low in both of cases where the average particle diameters are 6 and 8 $\mu$m, the case where the average particle diameter is smaller, that is, 6 $\mu$m is more remarkable for the initial lower density. The level of the initial low density in the case where the average particle diameter is 8 $\mu$m or more is 1.4 or more without any problems. On the other hand, in the case where the toner less than 8 $\mu$m in the average particle diameter is employed, it is found that the level of the initial low density is lowered down to a level which should be desirably improved.

According to the present inventors' study, it has been proved that the cause to lower the density is because there is a correlation between the amount of fine particles relatively small in particle diameter among the toner and the initial density of solid image (all black) (Macbeth reflection densitometer made by Macbeth Co., was used for density measurement) as shown in FIG. 16, and the density is lowered more as the amount of fine particles increases. The fine particles of toner are considerably different in triboelectricity from the normal toner. It has been proved that, in an initial stage, a tendency is given to allow the particles relatively small in the toner within the developing apparatus 208 to collect in the vicinity of the developing sleeve 105 at a stage where the developing apparatus starts to operate, with the result that the triboelectricity distribution of the toner coated on the developing sleeve 105 is broadened (the ratio of toner having an optimum triboelectricity for development to all the toner is reduced), and developing capacity is lowered. Because the existence of the toner small in particle diameter leads to any problem, the above phenomenon is liable to remarkably appear as the average particle diameter of toner is smaller. In addition, it has been found that this phenomenon becomes more remarkable as a pattern small in toner consumption continues to be printed (for example, solid image immediately after blank copy (all white) continues to be printed is more lowered). This is because the amount of fine particles in the vicinity of the developing sleeve 105 increases more as the toner consumption is reduced.

FIG. 14A is a diagram showing the movement of toner within the conventional developing apparatus 208 using the crank-shaped agitating member 130. In the figure, the supply of new toner from the side of the developing container 104 is conducted in two ways, that is, conducted by allowing the new toner to pass through a space below the agitating member 130 as indicated by an arrow 4 and conducted by allowing the new toner to flow in a space between the agitating member 130 and the antenna member 108 due to the self weight action of toner as indicated by an arrow 5 as shown in FIG. 14B. The toner that has flown in the vicinity of the developing sleeve 105 in the directions indicated by the arrows 4 and 5 is attracted by the magnetic force of the magnet 106 inside of the developing sleeve 105. Thereafter, the toner is coated on the developing sleeve 105 by means of the elastic blade 107. The toner which has not been coated on the developing sleeve 105 is circulated in a direction indicated by an arrow 2 or an arrow 3. This circulation of toner contributes to the supply of triboelectricity to toner. According to the present inventors' study, it has been found that the amount of toner which flows into a space between the agitating member 130 and the antenna member 108 when the space is broadened during the rotation of the agitating member 130 is far larger than the amount of toner which is pushed and supplied in a rotationally advancing direction with the rotation of the agitating member 130. It has been also found that the flow of the large amount of toner causes the initial low density to occur. In other words, it has been proved that in a structure having the antenna member 108 as in the above-described structure of the developing apparatus 208, there is required a structure in which the flow of toner into the space between the crank-shaped agitating member 130 and the antenna member 108 is so controlled as to optimize the supply of toner toward the side of the developing sleeve 105.

As means for eliminating the above problem, there has been first proposed that the particle diameter of toner is unified (the fine particle side is cut during manufacturing). However, because the yield at the time of manufacturing the toner is remarkably deteriorated, thereby leading to the high costs, such means cannot be realized.

Also, there has been proposed in Japanese Patent No. 2682003 that, at the side of the developing sleeve within a toner containing (receiving) tank in the developing apparatus, a partition member is disposed at an inner lower side of the developing apparatus, and a supply chamber for supplying the toner by the agitating member is disposed within a cell in the toner receiving tank which is disposed between the partition member and the developing sleeve, in such a manner that the toner within the cell is used for development in priority to stably supply the toner having a uniform particle diameter. However, because a toner carrying force sufficient to get over the wall from the lower side is demanded, the performance request to the agitating structure is severe, thereby leading to the increased costs. Also, in a system where the center of gravity of the developing container is located above the rotating center of the developing sleeve, the inflow of toner from the arrows 4 and 5 in FIGS. 14A and 14B can be suppressed. However, in the case where an agitating member small in rotational torque and low in the costs is employed as the agitating member, or in the case where the supply of toner is conducted due to only the self-weight drop of toner without the provision of the agitating member, the absolute supply amount of toner to the above-described cell is liable to be lacking and the supply of toner to the developing sleeve becomes unstable, resulting in the possibility that a blank stripe occurs on the image even if a large amount of toner exists in the developing container.

Further, there has been proposed in Japanese Patent Application Laid-open No. 10-104943 that a protective wall is projected downward from an upper wall portion of the developing chamber in the extreme vicinity of the toner layer regulation member to the same degree as the toner layer regulation member. However, even in this structure, the inflow of toner in a direction indicated by the arrow 5 shown in FIG. 14B cannot be suppressed, thereby making it possible to prevent the initial density from being lowered.

SUMMARY OF THE INVENTION

The present invention has been made under the above circumstances, and therefore an object of the present invention is to provide a developing apparatus that prevents an initial image low density which is caused by the excessive supply amount of a developer to a developer bearing member.

Another object of the present invention is to provide a developing apparatus that prevents a blank stripe image which is caused by the short supply amount of a developer to a developer bearing member.

Still another object of the present invention is to provide a developing apparatus that prevents a developer from dropping in the vicinity of a detecting member which detects the amount of the developer and an agitating member located under the detecting member.

The present invention in one aspect provides a developing apparatus including a developing container having an opening portion for containing a developer therein. A developer bearing member is rotatably disposed in the opening portion for bearing and carrying the developer. A partition portion partitions an inside of the developing container into a first area in which the developer bearing member is provided and a second area in which the developer bearing member is not provided. Except for a developer passing opening, the partition portion extends downward from an upper and inner portion of the developing container. A detecting member extends along a longitudinal direction of the developer bearing member within the first area for detecting an amount of developer within the developing container. The detecting member is disposed above a horizontal line passing through a rotational center of said developer bearing member. A first agitating member is rotatably disposed below the detecting member within the first area for agitating the developer. A second agitating member is disposed within the second area for agitating the developer, and wherein assuming that a tangent, which is in contact with the detecting member on the opening portion side in a vertical direction is a first tangent, and a tangent, which is in contact with a rotating locus of the first agitating member on an opposite side of the opening portion in a vertical direction is a second tangent, the first tangent is positioned nearer to the opening portion than the second tangent, and a lower end of the partition portion forming said developer passing opening is provided between the first tangent and the second tangent.

Other objects and advantages of the present invention will become apparent during the following discussion conjunction with the accompanying drawings.

BRIEF DESCRIPTION OF THE DRAWINGS

FIG. 17 is a table for explaining the differences of the density of solid image, the amount of fine particles and fading with respect to a difference in the height of the leading edge of the partition member.

FIG. 18 is a table for explaining the differences of the density of solid image, the amount of fine particles and fading when the height of the leading edge of the partition member is changed at a center portion and an edge portion thereof.

DESCRIPTION OF THE PREFERRED EMBODIMENTS

Now, a description will be given in more detail of preferred embodiments of the present invention with reference to the accompanying drawings.

(First Embodiment)

Figure 1:
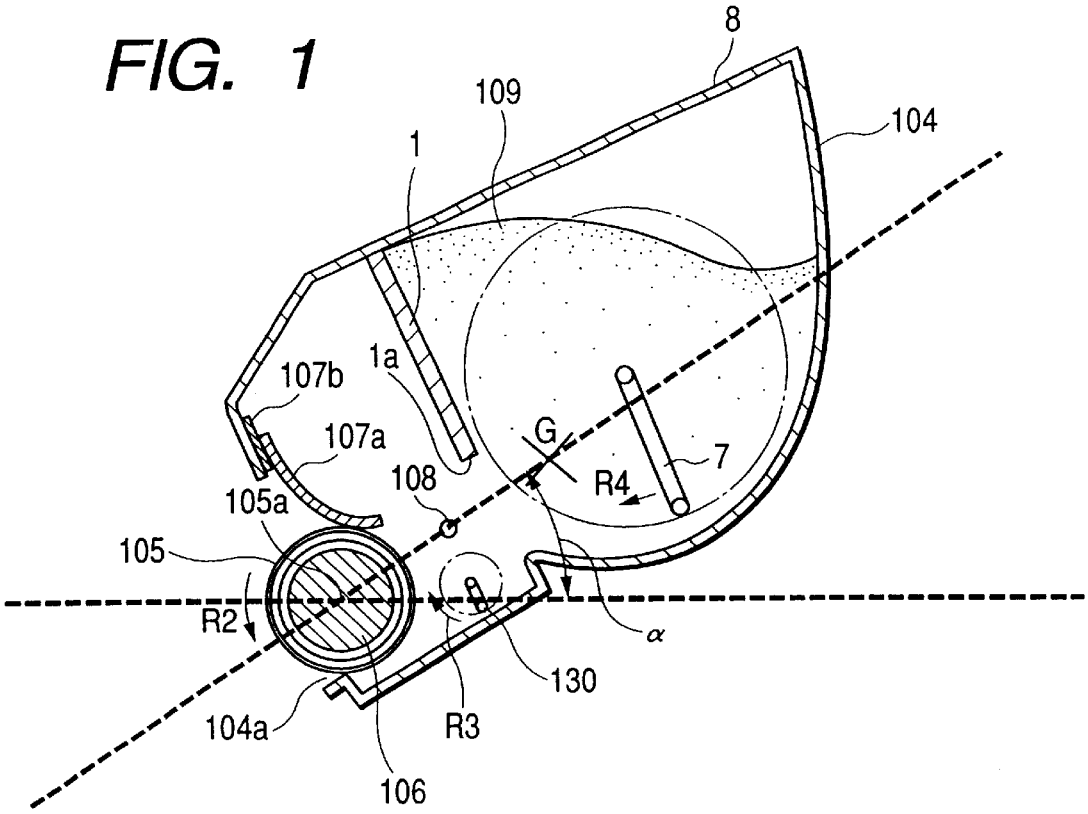
FIG. 1 is a vertical cross-sectional view showing a developing apparatus in accordance with a first embodiment of the present invention.
Figure 3:
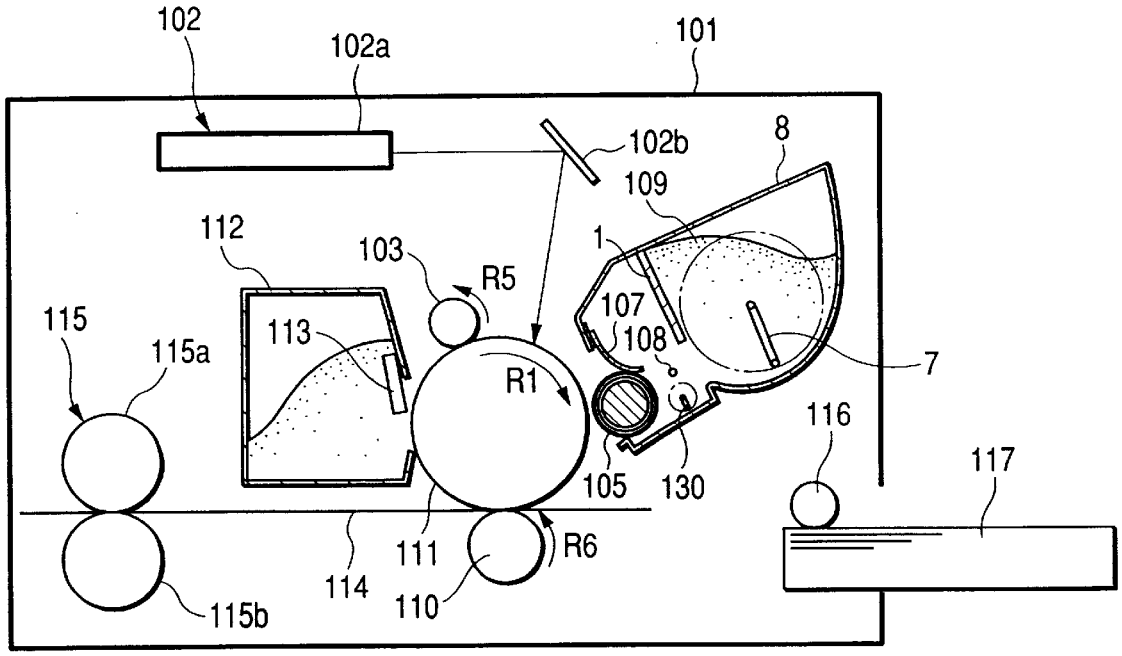
FIG. 3 is a vertical cross-sectional view showing an image forming apparatus in accordance with the first embodiment.

FIG. 1 shows an example of a developing apparatus in accordance with the present invention. The figure is a longitudinal cross-sectional view showing the schematic structure of the developing apparatus. FIG. 3 shows an example of an image forming apparatus having the developing apparatus in accordance with the present invention. The figure is a longitudinal cross-sectional view showing the schematic structure of the image forming apparatus.

First, referring to FIG. 3, the entire image forming apparatus will be described. Subsequently, referring to FIG. 1, a fixing device will be described in detail.

Figure 15:
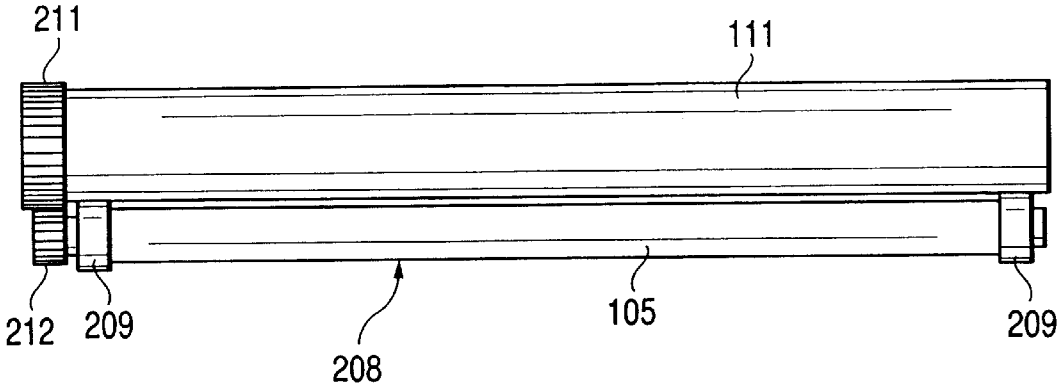
FIG. 15 is a diagram showing a relation between a photosensitive drum and a developing sleeve.
Figure 16:
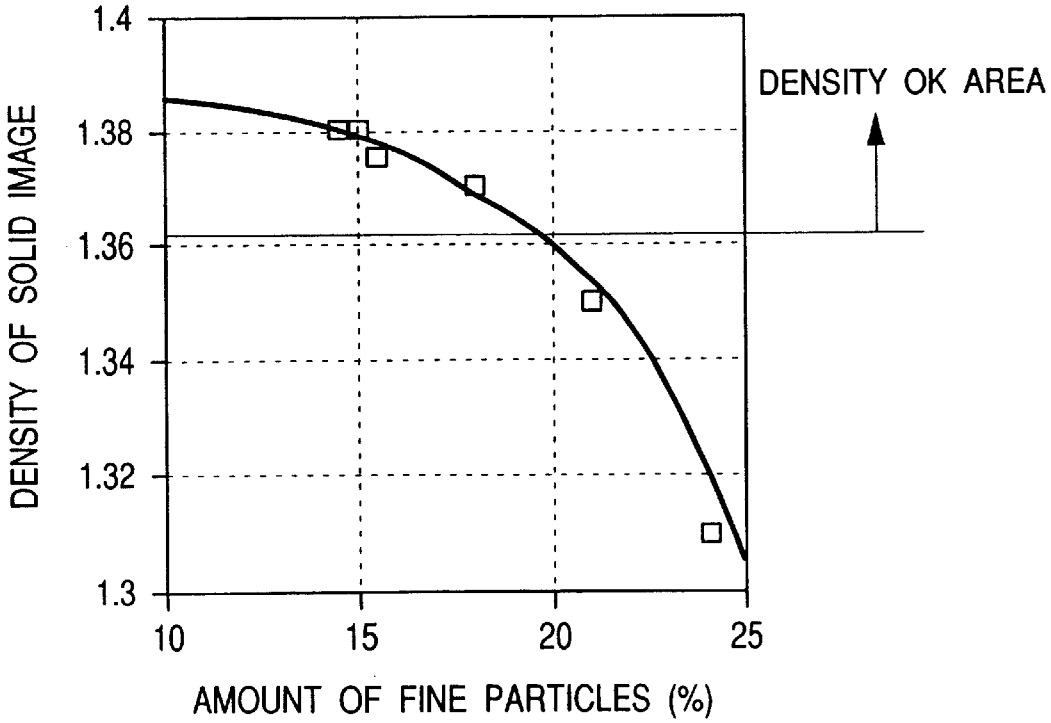
FIG. 16 is a diagram showing a relation between the amount of fine particles of toner and the density of solid image.

An image forming apparatus shown in FIG. 3 includes a main body 101 of an image forming apparatus (hereinafter referred to simply as "apparatus main body") as a printer engine. A drum-type electrophotographic photosensitive member (hereinafter referred to as "photosensitive drum") 111 is disposed inside of the apparatus main body 101 as an image bearing member. The photosensitive drum 111 is fixed with a photosensitive drum gear 211 at one end portion thereof in the longitudinal direction (axial direction) as shown in FIG. 15. The photosensitive drum 111 is rotationally driven at a predetermined process speed (peripheral speed) in a direction indicated by an arrow R1 in FIG. 3 with the axis as a center while a driving force is transmitted to the photosensitive drum gear 211 from driving means (not shown).

The surface of the photosensitive drum 111 is charged by a charging roller 103 as a charging device. The charging roller 103 is disposed in contact with the surface of the photosensitive drum 111 and driven in a direction indicated by an arrow R5 with the rotation of the photosensitive drum 111 in a direction indicated by the arrow R1. A charge bias where, for example, an a.c. voltage and a d.c. voltage are superposed on each other is applied to the charging roller 103 by a charge bias apply power source (not shown). As a result, the surface of the photosensitive drum 111 is uniformly charged with a given polarity and a given voltage.

The surface of the photosensitive drum 111 which has been charged is formed with an electrostatic latent image by an exposing device 102. The exposing device 102 includes a laser scanner 102*a*, a polygonal mirror (not shown), a reflection lens 102*b* and so on. The exposing device 102 irradiates a laser beam onto the surface of the photosensitive drum 111 on the basis of image information and then removes charges from the irradiated portion of the photosensitive drum 111 surface, to thereby form an electrostatic latent image.

Toner is adhered to the electrostatic latent image thus formed on the surface of the photosensitive drum 111 by a developing apparatus 8 according to the present invention and developed as a toner image. The developing apparatus 8 will be described in more detail later.

The toner image formed on the surface of the photosensitive drum 111 is transferred onto a transfer material 114 by a transfer roller 110 as a transfer device. The transfer roller 110 is brought in pressure contact with the surface of the photosensitive drum 111 to constitute a transfer nip portion and rotated in a direction indicated by an arrow R6 by following with the rotation of the photosensitive drum 111 in a direction indicated by the arrow R1. The transfer nip portion nips and conveys the transfer material 114. The transfer material 114 is received in a sheet feed cassette 117 and supplied to the transfer nip portion by a sheet feed roller 116, a registration roller (not shown) and so on, in synchronism with the toner image on the photosensitive drum 111. A transfer bias having a polarity opposite to that of the toner image on the photosensitive drum 111 is applied to the transfer roller 110 by a transfer bias apply power source (not shown) simultaneously while the transfer material 114 is nipped and conveyed, as a result of which the toner image on the photosensitive drum 111 is transferred onto the transfer material 114.

The toner that has remained on the surface of the photosensitive drum 111 after the toner image has been transferred onto the transfer material 114 is removed by a cleaning blade 113 of a cleaning device 112. Thus, the photosensitive drum 111 is prepared for succeeding image formation.

On the other hand, the transfer material 114 to which the toner image has been transferred is conveyed to a fixing device 115 and then heated and pressurized by a fixing roller 115*a* and a pressurizing roller 115*b*, whereby the toner image is fixed onto the surface of the transfer material 114.

The transfer material 114 onto which the toner image has been fixed is discharged to the exterior of the apparatus main body 101, to thereby complete image formation.

Figure 10:
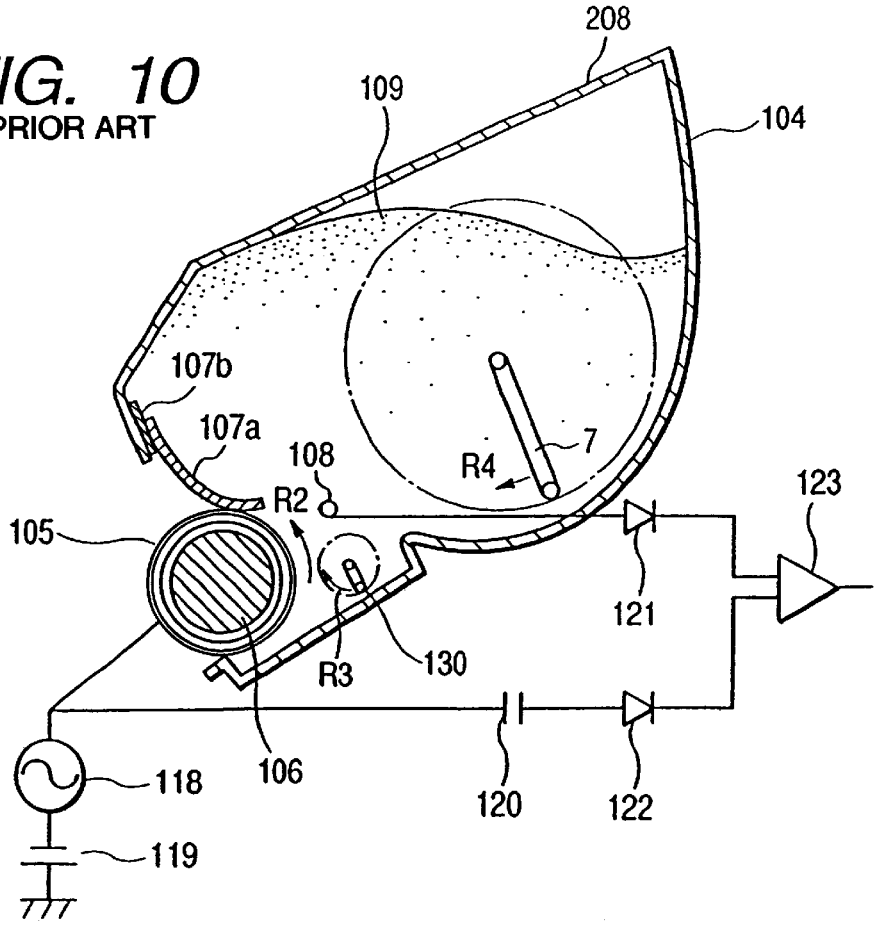
FIG. 10 PRIOR ART
FIG. 10 is a vertical cross-sectional view showing a conventional developing apparatus.

Subsequently, referring mainly to FIG. 1 and appropriately to FIGS. 10 to 12, the developing apparatus 8 according to the present invention will be described in more detail.

The developing apparatus 8 shown in those figures is comprised of a developing apparatus using one-magnetic-component toner and includes a developing container 104 that receives toner inside thereof. The developing container 104 has an opening portion 104*a* at a front side and lower portion thereof, where a developing sleeve 105 is disposed as a developer bearing member. The following description will be given provided that one side of the developing apparatus 8 opposite to the photosensitive drum 111 is a front side (left side in FIG. 1) whereas another side thereof far from the photosensitive drum 111 is a back side (right side in FIG. 1).

The developing sleeve 105 is comprised of a nonmagnetic sleeve which is formed of a pipe made of aluminum or stainless steel, and rotatably supported by the developing container 104 in a direction indicated by an arrow R2. The developing sleeve 105 is fixed with rollers 209 on both end portions thereof in its longitudinal direction (axial direction) as described with reference to FIG. 15. Those rollers 209 are allowed to abut against the photosensitive drum 111 to ensure a given gap (clearance) between the developing sleeve 105 and the surface of the photosensitive drum 111. One end portion of the developing sleeve 105 is fixed with a developing sleeve gear 212 to which a driving force is transmitted from the above-described photosensitive drum gear 211, to thereby rotationally drive the developing sleeve 105 in the direction indicated by the arrow R2. The surface of the developing sleeve 105 is so processed as to provide an appropriate surface roughness so that it can bear and carry a desired amount of toner. Also, a magnet 106 is disposed inside of the developing sleeve 105.

The magnet 106 is cylindrically shaped, and a plurality of N-poles and S-poles are alternately disposed in its peripheral direction. The magnet 106 is fixedly disposed inside of the developing sleeve 105 whereas the developing sleeve 105 rotates in the direction indicated by the arrow R2.

The surface of the above-described developing sleeve 105 abuts against an elastic blade 107*a* which functions as a developer regulation member. The elastic blade 107*a* is formed of a plate made of urethane rubber, silicon rubber or the like. The elastic blade 107*a* has its base end portion fixed onto a support plate 107*b* and has its leading end portion abutted against the surface of the developing sleeve 105 under a given pressure so that the elastic blade 107*a* is elastically deformed. The elastic blade 107*a* is so designed as to regulate the layer thickness of the toner 109 attracted onto the surface of the developing sleeve 105 due to the magnetic force of the above-described magnet 106. The toner which has been borne on the surface of the developing sleeve 105 is supplied with an appropriate amount of charges due to the frictional charge of the mutual toner which is caused by carrying the toner with the rotation of the developing sleeve 105 in the direction indicated by the arrow R2 and the frictional charge caused by a friction between the developing sleeve 105 and the elastic blade 107*a* at the time where the layer thickness of toner is regulated by the elastic blade 107*a*. The toner is then carried to a developing region opposite to the surface of the photosensitive drum 111. In this situation, a developing bias where an a.c. voltage and a d.c. voltage are superposed on each other by the a.c. developing bias supply power source 118 and the d.c. developing bias supply power source 119 is applied to the developing sleeve 105 through a slidable contact (not shown) as shown in FIG. 10. With the above operation, the toner on the developing sleeve 105 is flown to the photosensitive drum 111 and then electrostatically stuck to the electrostatic latent image in the developing region, to thereby develop the electrostatic latent image as a toner image.

As means for detecting the remaining amount of toner in the developing apparatus 8 thus structured, as described with reference to FIG. 10, a variation in current which is induced to an antenna member 108 by the a.c. developing bias supply power source 118 is detected by the antenna member 108 disposed in parallel with the developing sleeve 105, using a variation in impedance which is accompanied by a variation in the amount of toner between the developing sleeve and the antenna, to thereby estimate the remaining amount of toner. The induced current detecting means is made up of the respective members 120 to 123. Reference numeral 120 denotes a capacitor having an electrostatic capacitance equal to that in a state where no toner exists. The electrostatic capacitance of the capacitor 120 and an electrostatic capacitance detected by the antenna member 108 are compared with each other by a comparator 123 after they have passed through diodes 121 and 122, respectively, to thereby judge whether the toner exists or not.

In the case of detecting the remaining amount of toner, the antenna member 108 disposed inside of the developing container 104 in the longitudinal direction may prevent the movement of toner. In particular, because a toner wall is liable to be formed between the lower portion of the developing container 104 and the antenna member 108, a second agitating member 130 is disposed at the lower portion of the antenna member 108 so that the supply of toner to the developing sleeve 105 is smoothed while toner is being unraveled.

Figure 11:
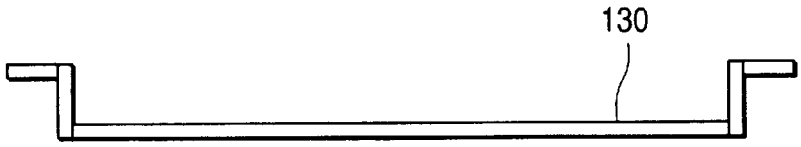
FIG. 11 is a diagram showing the configuration of a second agitating member in a longitudinal direction thereof.
Figure 12:
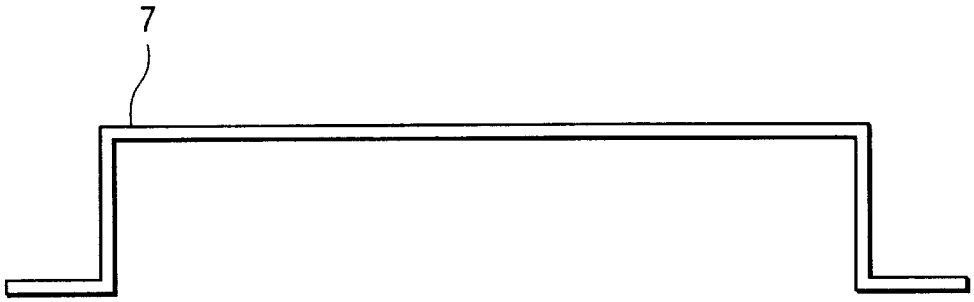
FIG. 12 is a diagram showing the configuration of a first agitating member in a longitudinal direction thereof.
Figure 13:
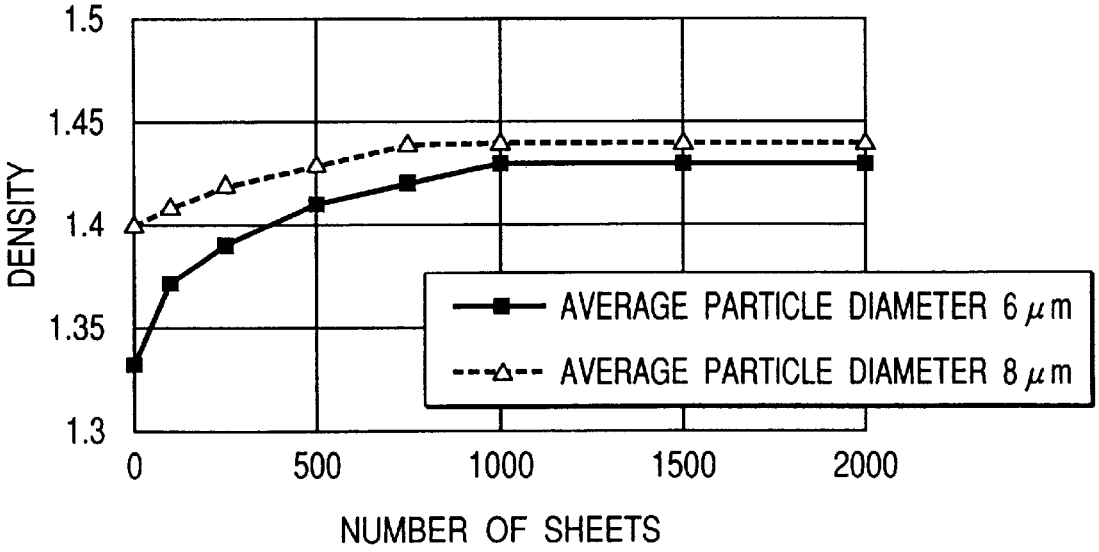
FIG. 13 is a graph showing a relation between the number of sheets and the density with respect to different average particle diameters of toner.

As the second agitating member 130, there is used a crank-shaped bar member as shown in FIG. 11, which is rotated in a direction indicated by an arrow R3 in FIG. 1 with both end portions thereof as a rotating center. Also, a first agitating member 7 is so disposed as to unravel the toner within the developing container 104 and deliver the toner to the agitating member 130. The first agitating member 7 is formed of a crank-shaped bar member as in the second agitating member 130 as shown in FIG. 12, which is rotated in a direction indicated by an arrow R4 in FIG. 1 with both end portions thereof as a rotating center. In general, a driving force that permits the first agitating member 130 and the second agitating member 7 to rotate is obtained, for example, by lowering the driving force transmitted from the above-described developing sleeve gear 212 (refer to FIG. 15) to an appropriate rotating speed through a gear train.

Subsequently, one example of the structural members of the developing apparatus 8 in accordance with this embodiment will be described in more detail with use of specific numeric values.

The developing sleeve 105 is formed of a nonmagnetic aluminum sleeve 16 mm in diameter. The surface of the developing sleeve 105 is coated with a resin layer having electrically conductive particles in order to carry the toner and give triboelectricity to the toner and formed in such a manner that the surface roughness is normally 0.4 to 3.5 $\mu$m in average by Ra of the JIS standard. In this embodiment, the average of the surface roughness is 0.95 $\mu$m by Ra.

As the magnet 106, a four-pole magnet roll where N-poles and S-poles are alternately disposed in its peripheral direction is used and fixedly disposed inside of the developing sleeve 105.

As the elastic blade 107*a*, a silicon rubber about 40 degrees in JIS hardness is allowed to abut against the surface of the developing sleeve 105 with an abutting force of 20 to 40 gf/cm (an abutting load per 1 cm in the longitudinal direction of the developing sleeve 105).

Toner as used is one-magnetic-component toner. As components, to 100 weight parts of styrene n-butyl acrylate copolymer as a binding resin, 80 weight parts of magnetic particle 80, 2 parts of load electric control agent of monoazo iron complex, and 3 parts of low-molar-weight polypropylene as a wax are melted and kneaded by a two-axial extruder which is heated at 140° C. A cooled mixture is roughly milled with a hammer mill, and a roughly milled product is finely milled with a jet mill. Then, the finely milled product thus obtained is air-separated to obtain separated particles having 5.0 $\mu$m weight mean diameter. The separated product having 5.0 $\mu$m weight mean diameter is mixed with 1.0 weight part of hydrophobic silica fine particles by a henshell mixer to obtain a developer. Then, the particles ranging from 3.5 to 7.0 $\mu$m in weight average particle diameter (mainly about 6 $\mu$m) is used. In the case where the above toner is used in the developing apparatus 8 structured in the above manner, the amount of toner coated on the developing sleeve 105 is about 0.5 to 2.0 mg/cm$^2$.

Now, the weight average particle diameter will be described.

A Coulter counter TA-II type (made by Coulter Electronics, Inc.) is used as a measuring device, and an electrolyte of first-grade sodium chloride is used to adjust 1% of NaCl aqueous solution. As a measuring method, 0.1 to 0.5 ml of a surface active agent is added to 100 to 150 ml of the above-described electrolyte aqueous solution as a dispersant, and 2 to 20 ml of a sample to be measured is further added thereto. The electrolyte in which the sample is suspended is subjected to a dispersion processing by an ultrasonic dispersing unit. Then, the distribution of particle size is measured with the number of particles as a reference by the above-described Coulter counter, using an aperture 100 $\mu$m as an aperture. As a result, the weight average particle diameter is found.

Also, as shown in FIG. 1, the developing container 104 is located obliquely upward in a vertical direction with respect to the rotational center 105*a* of the developing sleeve 105. With this arrangement, the center of gravity G of toner in the developing container 104 (the center of gravity at an initial stage where the developing container 104 is filled with toner) is situated obliquely upward in the vertical direction with respect to the developing sleeve 105. As a result, the gravity is effectively utilized so that the toner is readily carried in the vicinity of the developing sleeve 105, and the torque of the agitating member 7 can be reduced. Accordingly, even with the simple structure used in this embodiment, the toner can be sufficiently carried. If an angle $\alpha$ of the gravity G of toner in the developing container 104 with respect to the rotational center 105*a* of the developing sleeve 105 is 5 to 70 degrees with a horizontal line as a reference, the toner can be carried in the vicinity of the developing sleeve 105. In this embodiment, the gravity G is positioned obliquely upward by 40 degrees with respect to the rotational center 105*a* of the developing sleeve 105.

If the above-described angle is 50 degrees or more, because the toner on a bottom surface of the developing container 104 readily drops by the self-weight, the agitating member 7 in the developing container 104 is not always required.

As the developing bias which is applied to the developing sleeve 105, for example, assuming that a gap between the photosensitive drum 111 and the developing sleeve 105 is 300 μm, a d.c. voltage of −550 V, an a.c. voltage of rectangular waves Vpp of 1500 V and a frequency of 2200 Hz are applied to the developing sleeve 105.

The surface of the photosensitive drum 111 is charged to a dark portion potential $V_D$=−650 V by the charging roller 103, and thereafter the potential of an exposed portion, that is, a light portion potential $V_L$ is set to −150 V by laser exposure. With that operation, the above negative toner is stuck onto the portion of the light portion potential $V_L$ out of the surface of the photosensitive drum 111, that is, so-called reversal developing is conducted.

Subsequently, means for preventing an initial low density which is characterized by this embodiment will be described in detail.

In this embodiment, a partition member extending substantially downward from the upper portion of the developing container 104 is disposed on the developing sleeve 105 side within the developing container 104 to prevent a large amount of toner from flowing into a space between the antenna member 108 and the agitating member 130 due to the self-weight action of toner. This is a significant feature of this embodiment.

Figure 2:
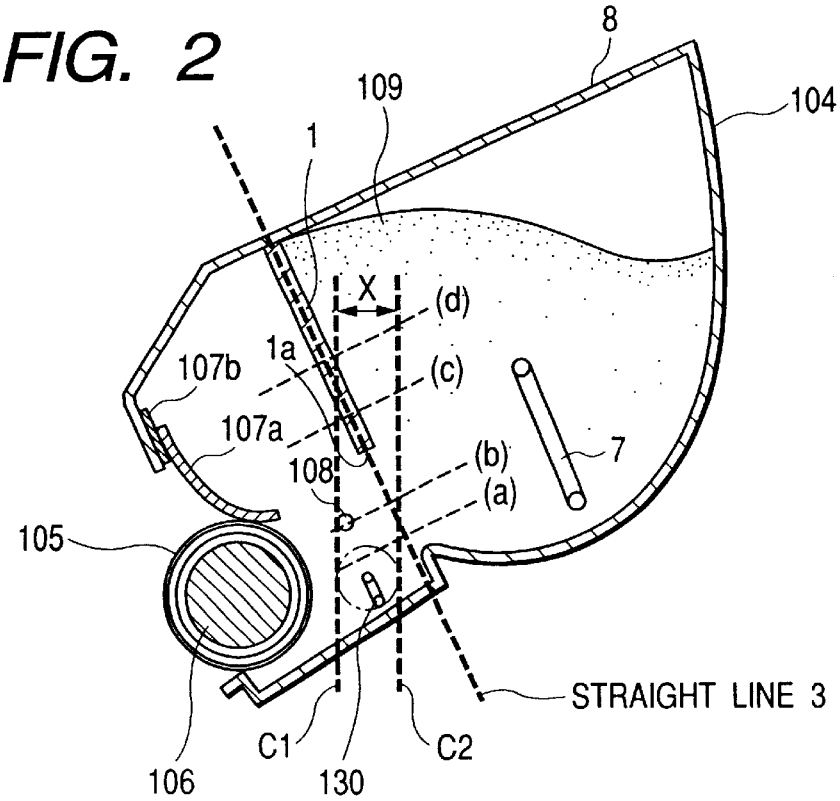
FIG. 2 is a diagram for explaining the position of a leading edge of a partition member in the developing apparatus in accordance with the first embodiment.
Figure 14A:
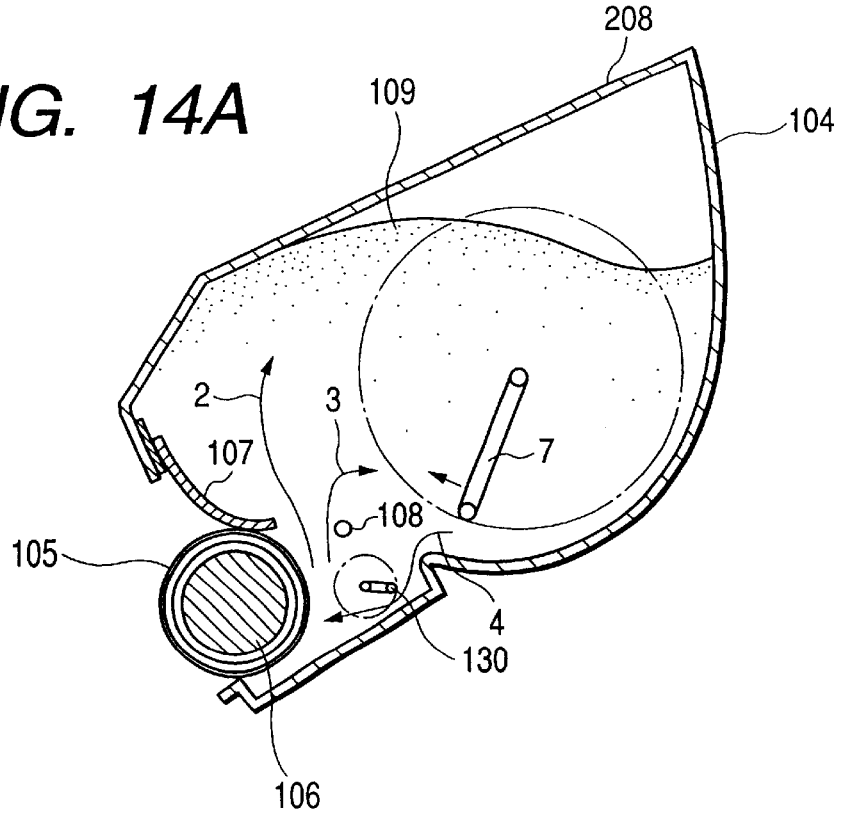
FIG. 14A is a diagram showing the flow of toner within the conventional developing apparatus.
Figure 14B:
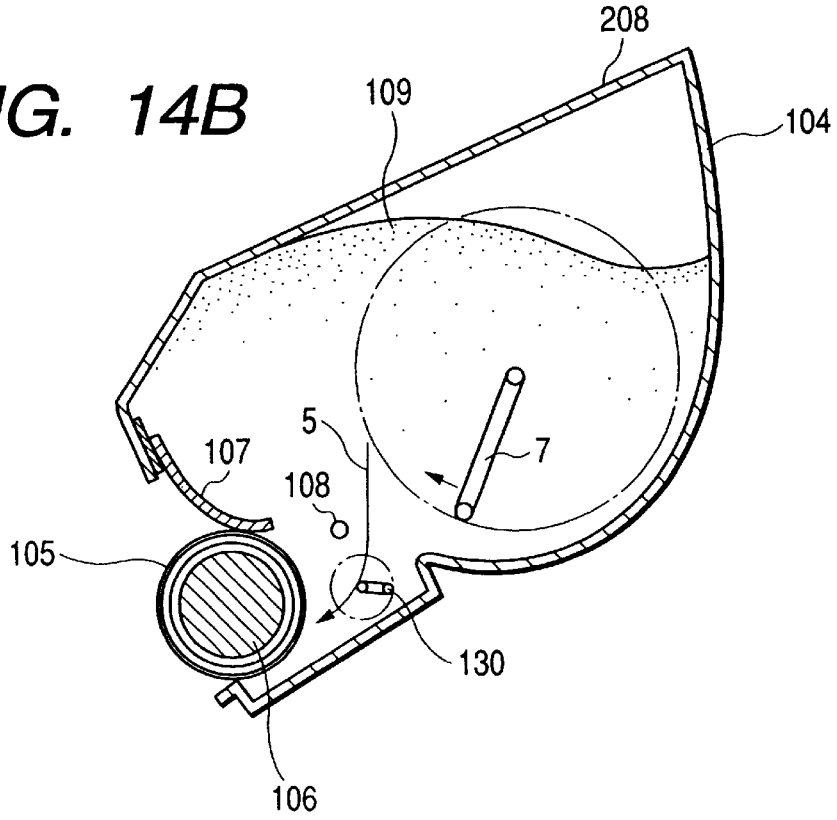
FIG. 14B is a diagram showing the flow of toner within the conventional developing apparatus.

The initial low density is caused, as described above, by the inflow of toner toward an arrow 5 shown in FIG. 14B, and this is mainly generated by dropping of toner from the antenna member 108 and the upper portion of the agitating member 130. Under the circumstances, in order to prevent the toner from dropping, in the developing apparatus 8 shown in FIG. 2, a partition member 1 is disposed on the upper portion within the developing container 104 as effective means in such a manner that a leading edge 1*a* of the partition member 1 is positioned within a region X interposed between a tangent (first tangent) C1 which is in contact with the antenna member 108 on the developing sleeve 105 side (the opening portion side of the developing container) and drawn vertically and a tangent (second tangent) C2 which is in contact with the rotating locus of the agitating member 130 on an opposite side of the developing sleeve 105 side and drawn vertically. Also, in order to prevent the toners from dropping from the upper portion within the region X, the partition member 1 is connected to the developing container 104. It is preferable that the upper end of the partition member 1 is located in the vicinity of the opening portion of the developing container 104 rather than within the region X. In other words, it is preferable that the partition member 1 is inclined with respect to the vertical direction.

Subsequently, the results of studying the developing apparatus 8 in which the partition member 1 is located, which is one example of designing the optimum structure of the partition member 1, will be described.

While the height of the partition member 1 is variously changed, that is, the position of the lower leading edge 1*a* of the partition member 1 is changed to positions (a), (b), (c) and (d), the developing characteristics of the developing apparatus 8 such as the initial density at the respective positions were compared with the conventional developing apparatus 208 with no partition member 1 as a reference.

In the experiment, attention has been paid to the effect of the height of the partition member 1 on the initial low density and the occurrence of fading (blank stripe of an image) which is caused by the short supply of toner to the developing sleeve 105 which is a supposed adverse influence of the provision of the partition member 1.

The detailed experimental contents will be stated below.

[Experiment 1]

(Experimental Conditions)

Experimental environments: temperature 23° C., humidity 60%

Process speed of the image forming apparatus (photosensitive drum 111): 80 mm/sec Diameter of the antenna member 108: 2.0 mm Distance between the lower portion of the antenna member 108 and the rotational center of the agitating member 130: 6.0 mm Rotating locus diameter of the agitating member 130: 6.5 mm Rotating speed of the agitating member 130: 35 rpm Position (a) of the leading edge 1*a* of the partition member 1: a position farther than the tangent C2 from the developing sleeve 105 outside of the region X Position (b) of the leading edge 1*a* of the partition member 1: a position close to the tangent C2 inside of the region X Position (c) of the leading edge 1*a* of the partition member 1: a position close to the tangent C1 inside of the region X Position (d) of the leading edge 1*a* of the partition member 1: a position nearer than the tangent C1 to the developing sleeve 105 outside of the region X (Experimental Method)

1. While the height of the lower leading edge of the partition member 1 is changed, a blank copy image is first outputted to 10 sheets at the respective positions in the developing apparatus 8. This is because the amount of fine particles in the vicinity of the developing sleeve 105 is increased to make the density remarkably low.

2. A solid image is outputted to one sheet to measure the image density. This is to confirm the effect to the initial low density. The measurement of density was made with a Macbeth reflection densitometer (made by Macbeth Co.).

3. After the blank stripe image has been again outputted to 10 sheets, a toner sample on the developing sleeve 105 is extracted, and the amount of fine particles in the toner sample is measured. This is because the effect is judged on the basis of the amount of fine particles which directly cause the low density. The measurement of the particle diameter of toner is that the particles having the diameter of 3.2 μm or less are judged as fine particles and the rate of the fine particles to all the particles is calculated, using a Coulter multilizer (made by Coulter Electronics, Inc.). In the toner applied to this experiment, the content of the fine particles 3.2 μm or less in diameter at the time of manufacturing was about 13%.

4. Thereafter, solid image is outputted to 30 sheets to judge the presence/absence of occurrence of fading and the degree of fading from the sample.

The results of the above-described experiment are exhibited in FIG. 17.

As apparent from the figure, the relation between the respective positions of the leading edge 1*a* of the partition member 1 and the density is that the effects at both the positions (a) and (b) are large and substantially equal to each other. Also, the amount of fine particles on the developing sleeve 105 at the positions (a) and (b) is close to about 13% of the content of fine particles at the time of manufacturing. At the position (c), although the density is somewhat lowered as much as the amount of fine particles increases, the effect is found. At the position (d), the density and the amount of fine particles are equal to those of the reference, and an improvement in the initial low density cannot be obtained.

The relation between the respective positions of the leading edge 1*a* of the partition member 1 and fading is that fading occurs at the position (a), but no fading occurs at the positions (b), (c) and (d).

Subsequently, the circulation of toner at the respective positions (a), (b), (c) and (d) has been observed.

Figure 4A:
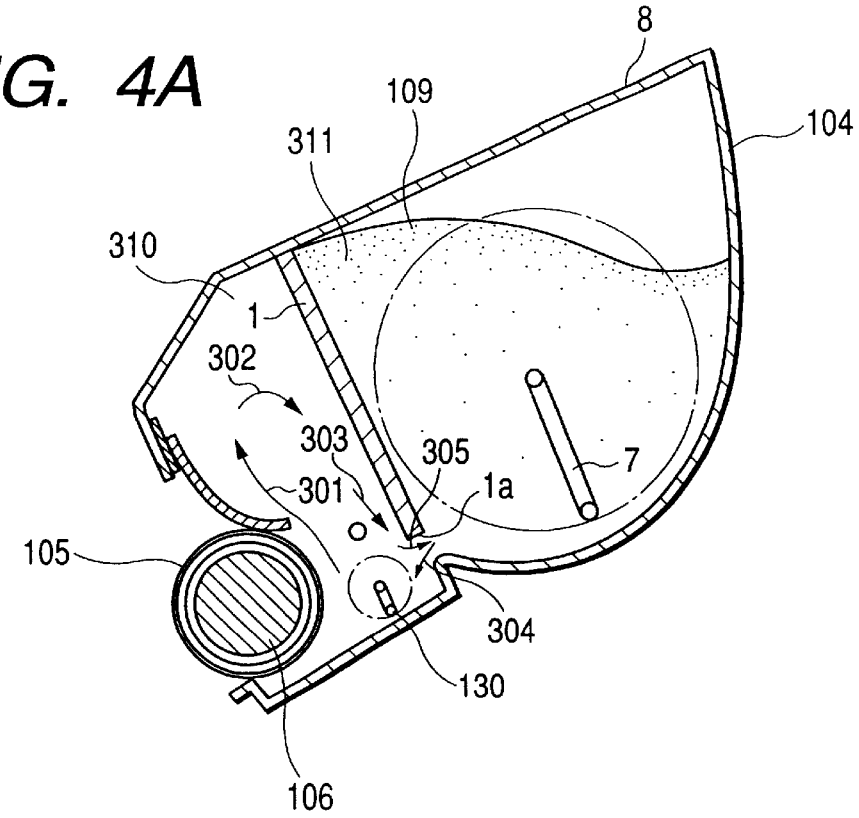
FIG. 4A is a diagram for explaining the flow of toner in the case where the leading edge of the partition member is at a position "a" in FIG. 2 in the first embodiment.

The circulation of toner at the position (a) consists of, as shown in FIG. 4A, a large circulation in which the toner circulates in the stated order of arrows 301, 302 and 303 in a space 310 defined toward the developing sleeve 105 side from the partition member 1, and a slight circulation 305 in which the toner flows from the space 310 toward a space 311. Also, because the leading edge 1*a* of the partition member 1 at the position a is located backside (right side of FIG. 2) of the developing container 104 with respect to the tangent C2, the toner is prevented from flowing into a space between the antenna member 108 and the agitating member 130 as indicated by the arrow 5 in FIG. 14B. As a result, it was found that the amount of fine particles on the developing sleeve 105 is prevented from increasing. However, because an opening area of the partition member 1 which links the space 311 at the agitating member 7 side to the space 310 is small, the toner is not sufficiently carried from the agitating member 7 toward the agitating member 130 in the direction of an arrow 304, as a result of which, it has been found that the supply of toner when continuously printing the solid image is not in time, to thereby generate fading.

In order to prevent fading, it is necessary to sequentially carry sufficient toner from the agitating member 7 toward the agitating member 130. To achieve this, toner must be carried within the rotating locus of the agitating member 130. It is considered that if the leading edge 1*a* of the partition member 1 is located at least on the developing sleeve 105 side with respect to the tangent C2 of the rotating locus of the agitating member 130, it is possible to carry the toner from the agitating member 7 to the agitating member 130. In other words, the reason that fading occurs at the position (a) is because the leading edge 1*a* of the partition member 1 decreases the amount of toner supplied from the agitating member 7 to the agitating member 130, that is, the leading edge 1*a* of the partition member 1 is located backside of the developing container 105 with respect to the tangent C2.

Figure 4B:
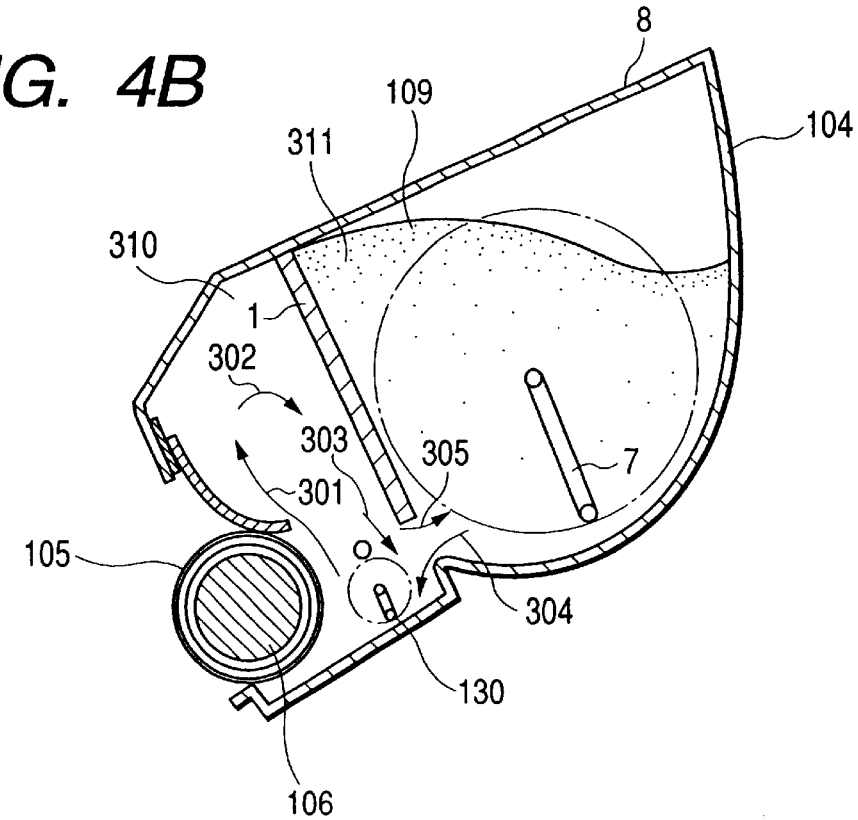
FIG. 4B is a diagram for explaining the flow of toner in the case where the leading edge of the partition member is at a position "b" in FIG. 2 in the first embodiment.

The circulation of toner at the position (b) consists of, as shown in FIG. 4B, a flow indicated by the arrow 303 in which the toner circulates from the arrow 301 toward the arrow 302 and thereafter flows to the side of the agitating member 130 within the space 310, and another flow indicated by the arrow 305 in which the toner flows toward the space 311. Also, because the leading edge 1*a* of the partition member 1 at the position b is within the region X, the flow of toner into the space between the antenna member 108 and the agitating member 130 as indicated by the arrow 5 of FIG. 14B is greatly suppressed. For that reason, it has been found that because the toner is not more supplied from the space 311 as required at the position (b) similarly to the position (a), the amount of fine particles on the developing sleeve 105 is prevented from increasing. In addition, it has been found that because the position of the leading edge 1*a* of the partition member 1 exists on the side of the developing sleeve 105 with respect to the tangent C2, the toner is sufficiently supplied from the space 311 to the space 310 in the direction of the arrow 304, and the toner can be sufficiently supplied onto the developing sleeve 105 even during the solid image continuously printing.

Figure 4C:
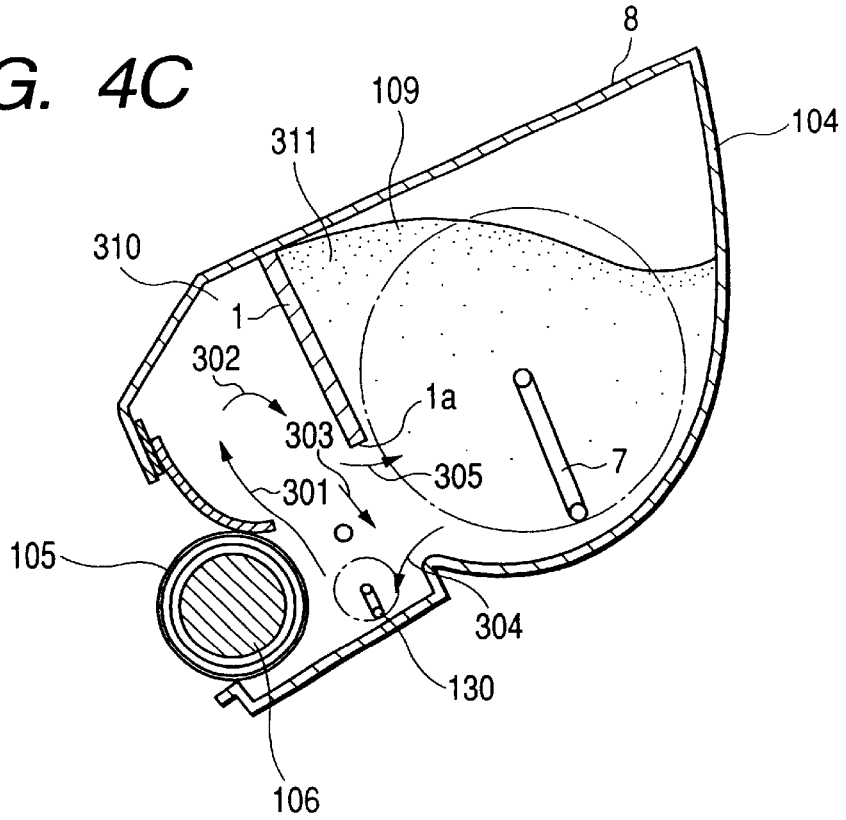
FIG. 4C is a diagram for explaining the flow of toner in the case where the leading edge of the partition member is at a position "c" in FIG. 2 in the first embodiment.

The circulation of toner at the position (c) is shown in FIG. 4C. At this position, the toner is liable to drop from the upper portion as compared with the position (b). Further, since an interval between the antenna member 108 and the partition member 1 is made long, a flow of toner indicated by the arrow 303 or a flow indicated by the arrow 305 in which the toner circulates from the space 310 toward the space 311 is dispersed and weakened more than that at the position (b). As a result, it has been found that the effect of suppressing the inflow of toner is weakened, and the supply of toner from the space 311 is somewhat increased such that the amount of fine particles on the developing sleeve 105 is somewhat increased more than that at the position (b).

Figure 4D:
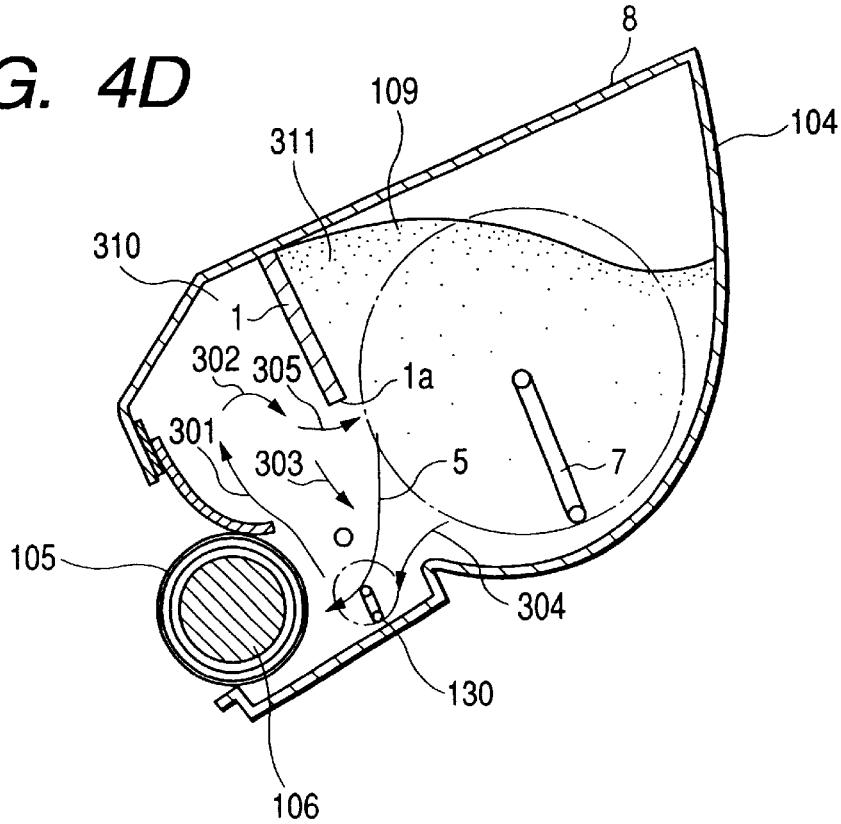
FIG. 4D is a diagram for explaining the flow of toner in the case where the leading edge of the partition member is at a position "d" in FIG. 2 in the first embodiment.

The circulation of toner at the position (d) is shown in FIG. 4D. At this position, the flow of toner into the space between the antenna member 108 and the agitating member 130 as indicated by the arrow 5 increases because the toner is liable to drop more than that at the position (c), and the flows indicated by the arrows 305 and 303 which provide the toner inflow suppressing effect are further weakened, the flow of toner into the space between the antenna member 108 and the agitating member 130 as indicated by the arrow 5 increases. As a result, it has been found that the supply of toner from the space 311 is increased, and the amount of fine particles on the developing sleeve 105 is also increased.

However, it has been found that, at the position (d), the toner is sufficiently supplied from the space 311 to the space 310 in the direction of the arrow 304, and even at the solid image continuous printing, the toner can be sufficiently supplied onto the developing sleeve 105.

On the basis of the above studying results, the developing apparatus can be structured without any problems in such a manner that the partition member 1 is situated downward from the upper portion of the developing container 104 and the position of the leading edge 1*a* of the partition member 1 is arranged within the region X which is interposed between the tangent C1 and the tangent C2. As a result, a large amount of toner can be suppressed from flowing into the space between the antenna member 108 and the agitating member 130, the amount of fine particles on the developing sleeve 105 can be prevented from increasing, the initial low density is improved, and the toner is sufficiently supplied to the developing sleeve 105.

Also, as a result of conducting a printing test using the developing apparatus 8 where the leading edge 1*a* of the partition member 1 is at the position (b) until the blank stripe of an image occurs, printing can be performed at high density until the toner within the developing container 104 is almost completely consumed. Further, an excellent image can be stably obtained without any occurrence of an adverse influence such as fading that causes the blank stripe of an image or the lack of the image.

It should be noted that this embodiment shows one example in which the optimum structure of the partition member 1 is obtained, and the present invention is not limited by or to this embodiment in another developing system and may provide a partition member suitable for that system.

Subsequently, another example of the agitating member 7 will be described with reference to FIGS. 19 and 20.

Figures 19, 21:
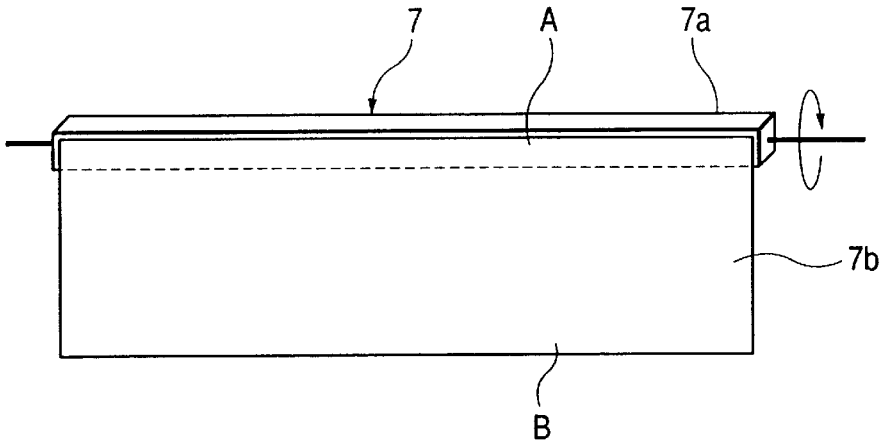
FIG. 19 is a substantially front view showing another example of the agitating member.
FIG. 21 is a table for explaining the differences of the density of solid image, the amount of fine particles and fading with respect to a difference in the height of the leading edge of the partition member.
Figure 20A:
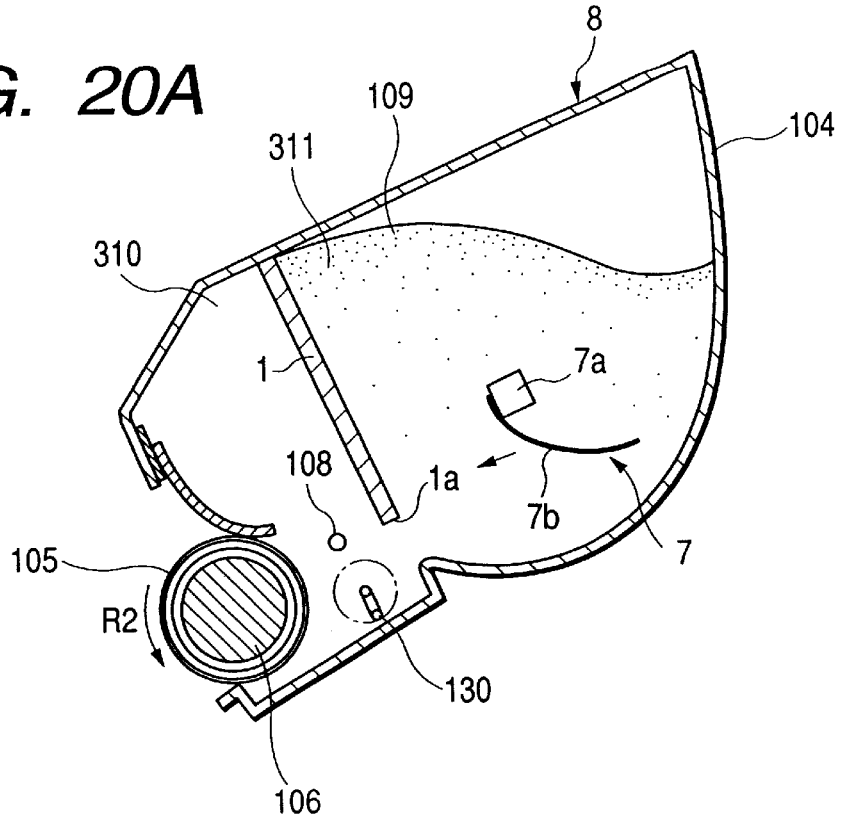
FIG. 20A is a diagram showing the operation of the agitating member when a large amount of toner exists within a developing container.
Figure 20B:
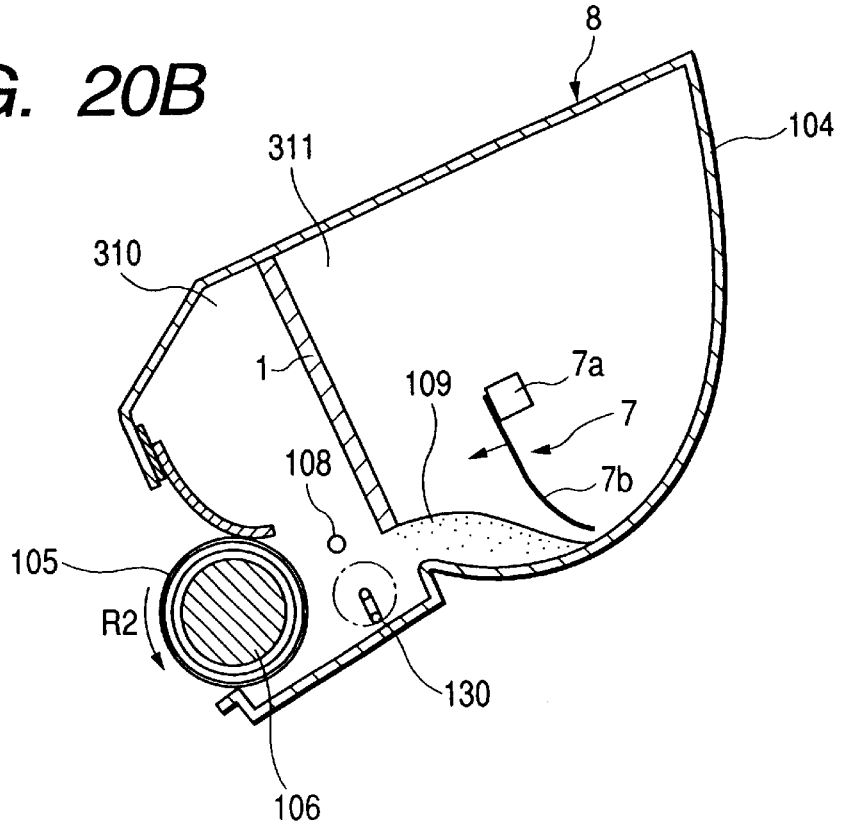
FIG. 20B is a diagram showing the operation of the agitating member when a small amount of toner exists within a developing container.

In this embodiment, the agitating member 7 is made up of, as shown in FIGS. 19, 20A and 20B, a rigid bar 7*a* having the rotational center which is in parallel with the rotational center of the developing sleeve 105, and an elastic sheet (developer carrying member) 7*b* a base edge portion A of which is fixed to the rigid bar 7*a* and a leading edge portion B of which is of a free end. The structures other than the agitating member 7 are identical with those described above.

In this embodiment, the partition member 1 is located obliquely downward from the upper portion of the developing container 104 on the side of the developing sleeve 105 within the developing container 104. When the amount of toner is large in an initial stage, a large amount of toner is prevented from flowing in the vicinity of the developing sleeve 105 due to the synergistic effect of the partition member 1 and the first agitating member 7 that weakens the carrying performance of toner. This is a significant feature of this embodiment.

Provided that the elastic sheet 7*b* of the agitating member 7 as used is made of PET (polyethylene terephthalate) and has a thickness of 100 $\mu$m, the diameter of the rotating locus circle is 35.0 mm and the rotating speed of the agitating member 7 is 10 rpm, an experiment has been conducted in the above-described experimental conditions and experimental method. The experimental results are exhibited in FIG. 21.

As apparent from the figure, the relation between the respective positions of the leading edge 1*a* of the partition member 1 and the density is that the effects at both the positions (a) and (b) are large and substantially equal to each other. Also, the amount of fine particles on the developing sleeve 105 at the positions (a) and (b) is close to about 13% of the content of fine particles at the time of manufacturing. At the position (c), although the density is somewhat lowered as much as the amount of fine particles increases, the effect is found. At the position (d), both the density and the amount of fine particles are close to those of the reference but higher in level than those of the reference (a state where no partition member exists) due to the action of the agitating member 7.

The relation between the respective positions of the leading edge 1*a* of the partition member 1 and fading is that fading occurs at the position (a), but no fading occurs at the positions (b), (c) and (d).

Sequentially, the actions and effects of the agitating member 7 will be described in more detail.

[Actions and Effects of the Agitating Member 7]

FIG. 19 is a diagram showing the details of the agitating member 7. Referring to the figure, the base edge portion A of the elastic sheet 7*b* is so structured as to be fixed onto the rigid bar formed of a rigid body (agitation support member) 7*a* and to rotate with a rotary shaft provided in the axis of the rigid bar 7*a* as a center.

FIGS. 20A and 20B are diagrams for explaining the actions of the agitating member 7. FIG. 20A shows an appearance in which, because a large amount of toner (developer) 109 is received with the developing container 104 in an initial state, the elastic sheet 7*b* is curved backward with respect to the rotating direction due to a load from the toner within the developing container 104 so that the supply of toner toward the side of the developing sleeve 105 is suppressed. On the other hand, FIG. 20B shows an appearance in which because the load from the toner is reduced in a state where the toner 109 is decreased, the elastic sheet 7*b* substantially returns to an original state, thereby making it possible to carry the toner on the bottom portion of the developing container 104.

Although the initial density heightening effect is higher as the thickness of PET used as the elastic sheet is thin, there arises such an adverse influence that the blank stripe of the image occurs in a last stage of use or the remaining amount of toner increases. From the viewpoint of total performance, it is most proper that PET is 100 $\mu$m in thickness.

The above description was given of an example in which PET is employed as a material in the elastic sheet 7*b* of the agitating member 7, however, the present invention is not limited to or by this. Substantially the same effect can be obtained even if another material only the thickness of which is so selected as to provide the same elastic characteristics is employed.

(Second Embodiment)

The feature of this embodiment resides in that the developing apparatus described in the above first embodiment is located within an integral cartridge container together with a photoelectric drum, a cleaning device and a charging roller (charging device) to constitute a process cartridge, and the process cartridge is detachably attached to the apparatus main body.

Figure 5:
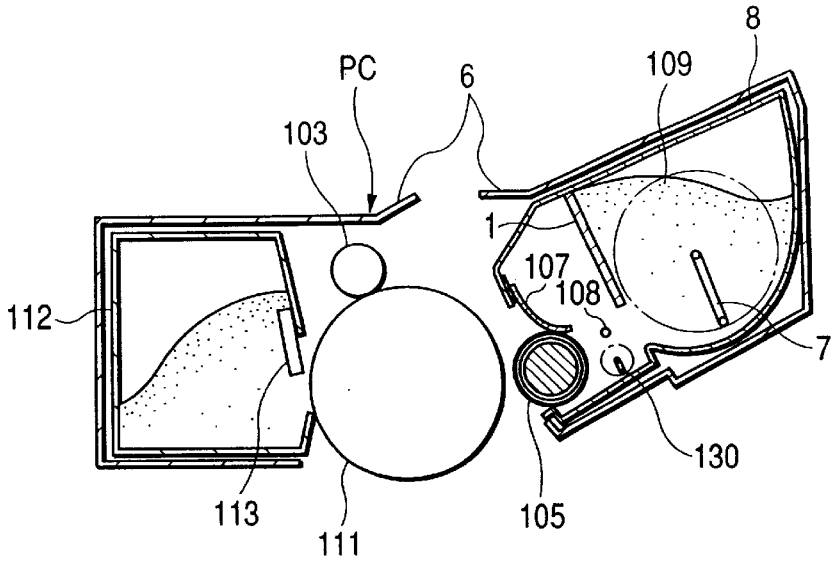
FIG. 5 is a vertical cross-sectional view showing a process cartridge in accordance with a second embodiment of the present invention.
Figure 6:
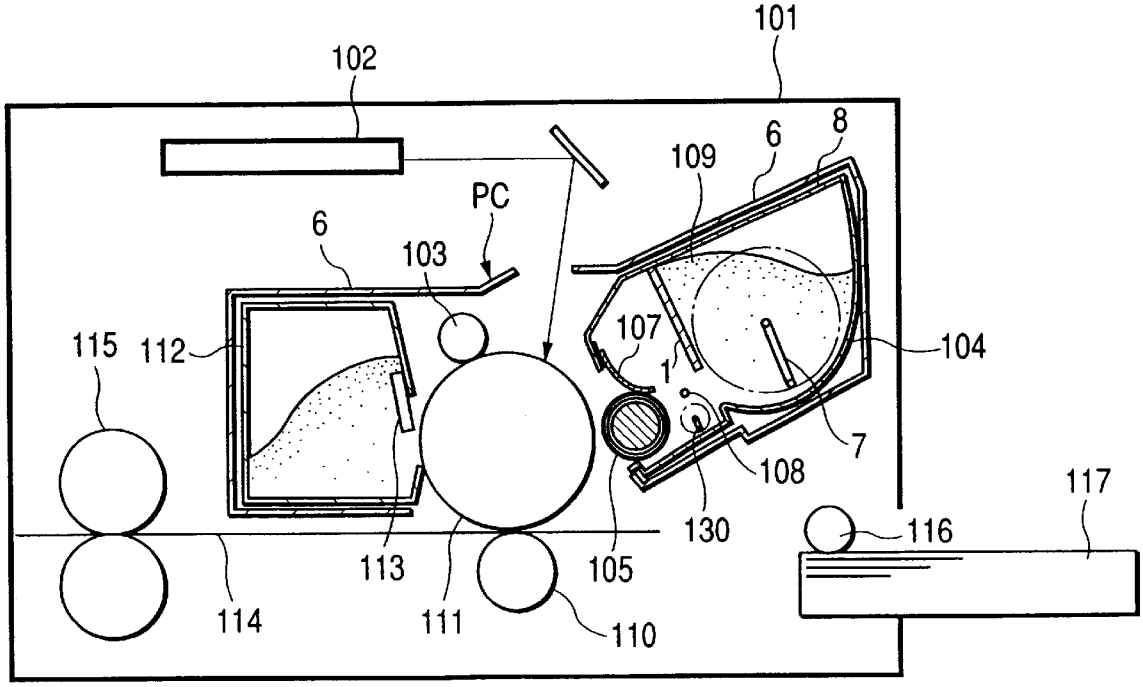
FIG. 6 is a vertically cross-sectional view showing an image forming apparatus to which the process cartridge is attached.

FIG. 5 is a vertical cross-sectional view showing an example of a process cartridge PC, and FIG. 6 is a vertical cross-sectional view showing an appearance in which the process cartridge PC is installed into the apparatus main body 101 of an image forming apparatus. In those figures, the same structures as those described in the above-described first embodiment are designated by identical references, and their description will be omitted.

In this embodiment, a developing apparatus 8, a photosensitive drum 111, a cleaning device 112 and a charging roller (charging device) 103 are integrated together by an integral cartridge container 6 to constitute a process cartridge PC. The process cartridge PC is designed such that when the developing apparatus 8 consumes all the toner 109, other devices, that is, the photosensitive drum 111, the charging roller 103 and the cleaning device 112 also end their lifetime substantially at the same time. Accordingly, because an image can be always stably obtained in a duration where the toner exists within the process cartridge PC, and those devices are of the integral type, there are advantageous in that those devices can be readily replaced by new ones.

If the partition member 1 described in the above first embodiment is located at an appropriate height in the developing apparatus 8 within the process cartridge PC, there is obtained such an advantage that a stable density is obtained from the initial stage in addition to the inherent advantage of the process cartridge PC.

The above description is given of an example of the process cartridge PC in which the respective process equipments essentially consisting of the photosensitive drum 111, the charging roller 103, the developing apparatus 8 and the cleaning device 112 are installed in the cartridge container 6. The process cartridge according to the present invention is not limited by or to this structure, and it is sufficient that at least the photosensitive drum 111 serving as the image bearing member and the developing apparatus 8 are provided. It is needless to say that the agitating member shown in FIGS. 19, 20A and 20B can be also employed.

(Third Embodiment)

The feature of this embodiment resides in that, as effective means for eliminating an initial low density in the case where the developing apparatus per se is so structured as to be liable to thin at end portions thereof as compared with a center portion in its longitudinal direction from the beginning, the height of the partition member disposed on the upper portion of the developing container is changed between the end portions and the center portion in its longitudinal direction, the density on the end portions which is relatively lower than that on the center portion is heightened to uniform the density in the longitudinal direction.

The following is a case in which the end portions of the developing apparatus are liable to thin as compared with the center portion.

In the developing apparatus where the developing sleeve 105, the photosensitive drum 111 or the like which is capable of printing an A3 size sheet, an LDR sheet, etc., is elongated in the longitudinal direction, there is a case in which a predetermined gap between the developing sleeve 105 and the photosensitive drum 111 is shorter at the center portion thereof than the end portions. In other words, referring to FIG. 15, because the rollers 209 are in contact with the photosensitive drum 111 on both the end portions of the developing sleeve 105, the weight of the developing apparatus is supported at both the ends thereof. For that reason, the center portion of the developing sleeve 105 which is not supported is pushed out toward the side of the photosensitive drum 111, as a result of which the interval between the center portion of the developing sleeve 105 and the photosensitive drum 111 is caused to be narrowed as compared with the end portions of the developing sleeve 105. Therefore, the end portions of the developing sleeve 105 is set to be small in the intensity of the electric field produced by application of a developing bias as compared with the center portion thereof, and a difference in the intensity of electric field between the end portions and the center portion remarkably appears in the initial stage where the developing property is low.

Figure 7:
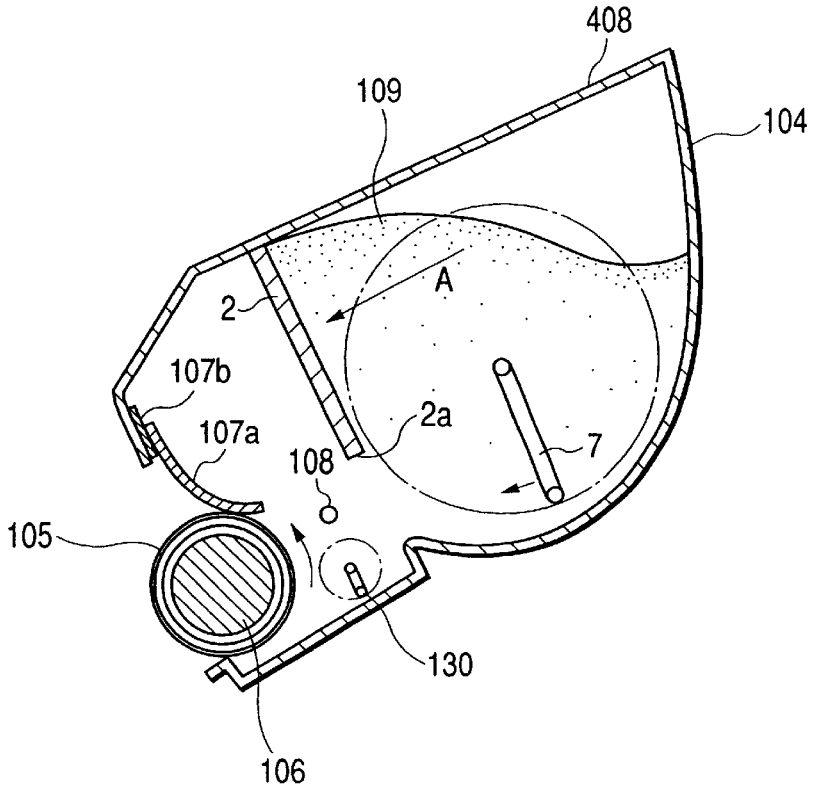
FIG. 7 is a vertically cross-sectional view showing a developing apparatus in accordance with a third embodiment of the present invention.

FIG. 7 shows a developing apparatus 408 exhibiting the feature of this embodiment. Referring to the figure, the components identical in structure with those in the above conventional example and the first and second embodiments are designated by the same references, and their description will be omitted.

Figure 8:
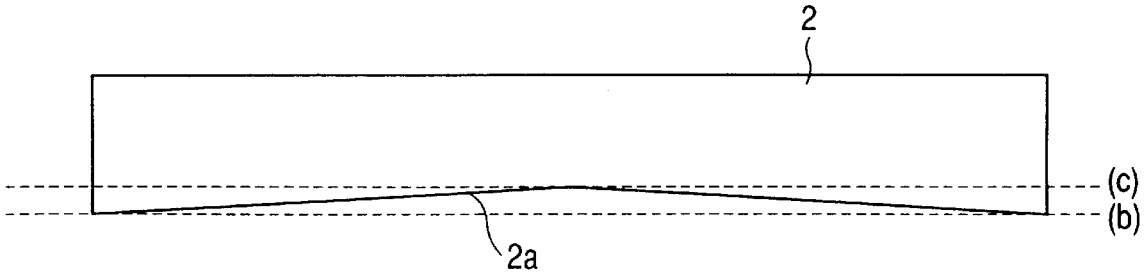
FIG. 8 is a diagram showing a partition member viewed from a direction indicated by an arrow A of FIG. 7 in the third embodiment.
Figure 9:
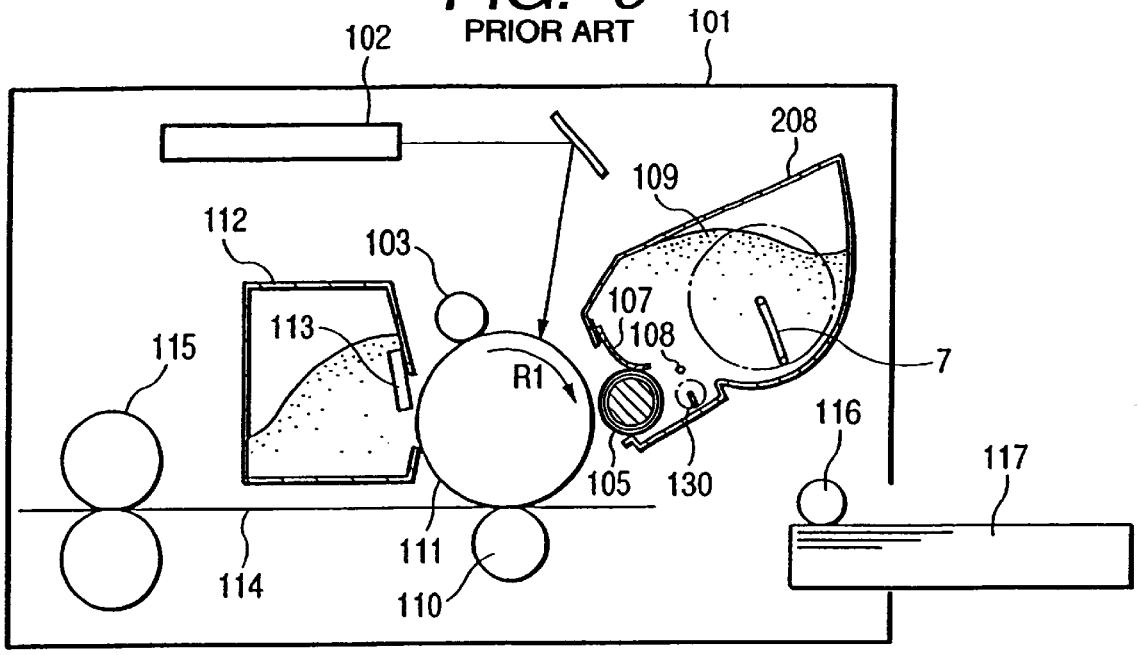
FIG. 9 PRIOR ART
FIG. 9 is a vertical cross-sectional view showing a conventional image forming apparatus.

FIG. 8 shows a partition member 2 viewed from an arrow A in FIG. 7. Referring to FIG. 8, the height of the partition member 2, that is, the position of a leading edge 2*a* of the partition member 2 is different in a longitudinal direction thereof. Then, in the state where the partition member 2 is located in the developing apparatus 408, the leading edge 2*a* of the partition member 2 at the end portions thereof is arranged at the position (b) in FIG. 2, and the leading edge 2*a* of the partition member 2 at the center portion is arranged at the position (c) in FIG. 2.

In the developing apparatus 408 in which the partition member 2 is located, the same experiment as that of the first embodiment has been conducted. In the study of this embodiment, the density of a solid image has been measured at positions corresponding to two portions of the end portion and the center portion of the developing sleeve 105 in the longitudinal directions.

The results are shown in FIG. 18.

Referring to FIG. 18, an image of a sufficient high density can be obtained at the edge portion of the developing sleeve 105 from the initial stage as in the first embodiment. Also, the center portion of the developing sleeve 105 is advantageous to the density so far as the interval between the photosensitive drum and the developing sleeve 105 at the center portion is naturally closer than that at the edge portions although the density heightening effect at the center portion is not as high as that at the end portions. For that reason, the density on the image in the longitudinal direction of the partition member 2 can be uniformed. In a system where a difference in density between the center portion and the end portions is still large, a difference in height between the center portion and the end portions of the partition member 2 may be further increased. Also, the partition member is provided only at the edge portions and the density is heightened only at the end portions so that the density can be uniformed in the longitudinal direction. In addition, the height of the partition member at the edge portions is not limited to the position in this embodiment, but may be at an appropriate position according to the performance of the developing apparatus before the partition member is provided in the developing apparatus.

As was described above, according to the present invention, since the height of the partition member 2 is made different between the center portion and the end portions in the longitudinal direction, the density can be heightened appropriately at the center portion and the end portions of the partition member 2 in the initial stage, respectively, thereby making it possible to uniform the density on the image in the longitudinal direction of the partition member 2.

What is claimed is:

1. A developing apparatus, comprising:

a developing container having an opening portion for containing a developer therein;

a developer bearing member rotatably disposed in the opening portion for bearing and carrying the developer;

a partition portion for partitioning an inside of said developing container into a first area in which said developer bearing member is provided and a second area in which said developer bearing member is not provided, except for a developer passing opening, said partition portion extending downward from an upper and inner portion of said developing container;

a detecting member extending along a longitudinal direction of said developer bearing member within said first area for detecting an amount of developer within said developing container, said detecting member being disposed above a horizontal line passing through a rotational center of said developer bearing member;

a first agitating member rotatably disposed below said detecting member within said first area for agitating the developer;

a second agitating member disposed within said second area for agitating the developer; and wherein assuming that a tangent which is in contact with said detecting member on the opening portion side in a vertical direction is a first tangent, and a tangent which is in contact with a rotating locus of said first agitating member on an opposite side of the opening portion in a vertical direction is a second tangent, the first tangent is positioned nearer to the opening portion than the second tangent, and a lower end of said partition portion forming said developer passing opening is provided between the first tangent and the second tangent.

2. A developing apparatus according to claim 1, wherein said partition portion is disposed obliquely with respect to the vertical direction.

3. A developing apparatus according to claim 2, wherein an upper end of said partition portion is disposed nearer to the opening portion than the first tangent.

4. A developing apparatus according to claim 1, wherein a center portion of the lower end of said partition portion is higher than both end portions thereof in a longitudinal direction of said developer bearing member.

5. A developing apparatus according to claim 1, wherein said second agitating member is rotatable, and a rotational center of said agitating member is disposed above a horizontal line passing through said detecting member.

6. A developing apparatus according to claim 1, wherein said second agitating member includes a flexible member a flexion amount of which is smaller as an amount of developer is small.

7. A developing apparatus according to claim 1, wherein said second agitating member includes a rigid bar, and an elastic sheet supported by the rigid bar.

8. A developing apparatus according to claim 1, wherein said detecting member detects a change in an amount of electrostatic capacity between said detection member and said developer bearing member.

9. A developing apparatus according to claim 1, wherein the weight average particle diameter of the developer is 7 $\mu$m or less.

10. A developing apparatus according to claim 1, wherein the developer includes a one-component magnetic developer and said developing apparatus further comprises magnetic field generating means disposed inside of said developer bearing member for allowing the developer to be born on said developer bearing member by a magnetic force.

11. A developing apparatus according to claim 1, wherein a center of gravity of the developer when said developing container is initially positioned above a horizontal line passing through a rotational center of said developer bearing member.

12. A developing apparatus according to claim 1, wherein said developing apparatus constitutes a process cartridge detachably attachable to a main body of an image forming apparatus together with an image bearing member for bearing an image.

* * * * *

UNITED STATES PATENT AND TRADEMARK OFFICE

CERTIFICATE OF CORRECTION

PATENT NO. : 6,226,464 B1
DATED : May 1, 2001
INVENTOR(S) : Koichi SUWA et al.

It is certified that error appears in the above-identified patent and that said Letters Patent is hereby corrected as shown below:

Column 5,
Line 43, "discussion" should read -- discussion in --.

Column 6,
Line 4, "vertically" should read -- vertical --;
Line 7, "vertically" should read -- vertical -- and;
Line 45, "substantially" should read -- substantial --.

Column 20,
Line 5, "born" should read -- borne -- and;
Line 8, "when" should read -- wherein --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*